US005808657A

United States Patent [19]

Kurtz et al.

[11] Patent Number: 5,808,657

[45] Date of Patent: Sep. 15, 1998

[54] LASER PRINTER WITH LOW FILL MODULATOR ARRAY AND HIGH PIXEL FILL AT A MEDIA PLANE

[75] Inventors: Andrew F. Kurtz; Sanwal P. Sarraf, both of Rochester, N.Y.

[73] Assignee: Eastman Kodak Company, Rochester, N.Y.

[21] Appl. No.: 668,041

[22] Filed: Jun. 17, 1996

[51] Int. Cl.[6] ..... B41J 2/47

[52] U.S. Cl. ..... 347/239; 347/244

[58] Field of Search ..... 347/241, 244, 347/239, 137, 134, 136; 359/623, 626, 298, 316, 319

[56] References Cited

U.S. PATENT DOCUMENTS

| | | | |
|---|---|---|---|
| 4,165,555 | 8/1979 | McMahon | 350/3.75 |
| 4,804,975 | 2/1989 | Yip | 346/76 L |
| 4,911,526 | 3/1990 | Hsue et al. | 350/96.24 |
| 5,030,970 | 7/1991 | Rau et al. | 346/108 |
| 5,262,888 | 11/1993 | Morishita et al. | 359/245 |
| 5,352,886 | 10/1994 | Kane | 260/216 |
| 5,363,233 | 11/1994 | Pernick | 359/316 |
| 5,453,876 | 9/1995 | Hamada | 359/625 |
| 5,521,748 | 5/1996 | Sarraf | 359/321 |
| 5,619,245 | 4/1997 | Kessler et al. | 347/241 |
| 5,629,791 | 5/1997 | Harrigan | 359/223 |
| 5,672,519 | 9/1997 | Song et al. | 437/3 |

*Primary Examiner*—Safet Metjahic
*Assistant Examiner*—Christopher E. Mahoney
*Attorney, Agent, or Firm*—Nelson Adrian Blish

[57] ABSTRACT

An imaging apparatus for a laser thermal printer (1) provides 100% fill at a media plane (60). The imaging apparatus (10) comprises a laser array (12), and focuses it on a modulator lenslet array (30). The illumination optics (13) combines light from each diode laser (14) in modulator lenslet array (30) and focuses light onto modulator sites (42) on the modulator array (40), with less than 100% fill. A printing lens (50) focuses an image of the modulator lenslet array onto a media plane (60) at essentially 100% fill.

13 Claims, 5 Drawing Sheets

LASER PRINTER WITH LOW FILL MODULATOR ARRAY AND HIGH PIXEL FILL AT A MEDIA PLANE

BACKGROUND OF THE INVENTION

1. Field of the Invention

This invention relates to laser printers in general, and in particular, to a laser printer with a low fill modulator array, and approximately a one hundred percent fill lenslet array.

2.Description of the Prior Art

In a typical laser printer, radiation from a laser is shaped, and imaged onto a media plane to produce a desired spot size. The spot, called a pixel, forms the smallest element of the image. The laser radiation is modulated to create the correct density of each spot, pixel by pixel. The laser spot is scanned in a line direction and the media is moved in a page direction to create a two dimensional image.

In a printer system with a continuous wave (CW) gas or solid state laser, an external modulator of the acoustic-optic or electro-optic type is used to input the image data into the optical beam, whereas, for systems with semi-conductor diode lasers, the laser radiation is typically modulated by varying the current input to the laser. For printers using high sensitivity media such as silver halide or an electrophotoconductor, high throughput is obtained by scanning the laser beam in the line direction by using a rotating polygonal mirror, a galvanometer, or a hologonal diffractive element. These printers are called "flying spot" printers.

For a low sensitivity media printer such as a laser thermal printer, higher power laser sources are used and exposure requirements are met by using a laser with a power output at the media plane on the order of 0.2–0.5 joules/cm$^2$ and scanning the beam slowly in both a line and a page direction. One way to achieve this type of scan is to configure the printer like a "lathe," where the page scan is obtained by rotating a drum which holds the film, and line scan by translating the laser in a direction parallel to the axis of rotation of the drum.

For higher throughput, higher power levels are required, which cannot be met by single diode laser technology. To achieve higher throughput, many discrete lasers are ganged together to form multiple spots on the media plane. Multiple pixels are written simultaneously to increase the throughput. A design for a printer using many discrete lasers coupled to optical fibers is disclosed in U.S. Pat. No. 4,911,526.

The cost of the discrete lasers and loss of efficiency in coupling the lasers to optical fibers, has prompted use of a monolithic array of lasers, which is an improvement on the basic concept of multiple lasers. The elements of the array are imaged directly onto the light sensitive media to produce multiple spots. Power to each element of the array is individually modulated to obtain pixel densities. A device of this type is disclosed in U.S. Pat. No. 4,804,975.

The complexity of fabricating an array where the power to each laser element must be individually modulated, and modulating the high current input to each element at high speeds, leaves room for improvement. Driver electronics currently available are expensive and difficult to manufacture, and the high power levels used to drive each element causes the printer to be sensitive to thermal and electrical cross talk effects, which can create image artifacts. Schemes to eliminate thermal and electrical cross talk are complex and expensive, and failure of even one element in the array makes it non-operational.

U.S. Pat. application Ser. No. 08/283,003, filed Jul. 29, 1994, assigned to the same assignee as the present invention, describes the optics for a multichannel, laser thermal printer using a directly modulated laser array. This system reduces thermal cross talk by constructing each source element as a subarray of single mode laser elements, separated by an air gap. However, using an array of sub-arrays, is expensive.

U.S. Pat. application Ser. No. 08/261,370, filed Jun. 16, 1994, assigned to the same assignee as the present invention, discloses a laser array and a reflective or transmissive modulator illuminated by the light from the laser array. The elements of the modulator break up the light beam into image elements, and each element of the modulator is subsequently imaged onto the media plane to form desired size spots. This improves upon other prior art designs by providing indirect light modulation means, so that the laser operates at full power, and serves only as a light source.

One obstacle to efficient operation of a laser printer system with light modulators, is that such modulators provide less than 100% optical fill. That is, pixels at the media plane do not touch adjacent pixels. This is because space is required for support structures to allow for electrical connections, resulting in modulator arrays in which modulator sites occupy only a part of the array, and because each diode laser of the laser array must be spaced apart from each adjacent diode laser to prevent cross talk. For example, the Texas Instruments Digital Mirror Device mirror array has a 90% fill at the media plane, and the Minolta lanthanum doped lead zirconate titanatc (PLZT) light shutter array has a 50% fill. Typically, the light which falls onto the regions between the modulator sites is lost to the system, which is inefficient.

U.S. Pat. application, Ser. No. 08/637,022 filed Apr. 24, 1996, assigned to the same assignee as the present invention, describes a modulator for a laser printer which provides a 100% fill at the media plane by placing electrodes on opposite sides of a PLZT structure, with the electrodes on a first side offset from the electrodes on a second side.

U.S. Pat. No. 5,262,888 describes an optical system incorporating a lamp focused onto a PLZT modulator array. The modulator array is imaged onto a drum in an electrophotographic printer. A 100% fill is obtained by supplying pixels in two staggered rows, wherein the pixels of one row are offset from the pixels in the other row. However, there is still a 50% fill within any one row. Since the optical system described is used for electrophotography and the required efficiency of light usage is not as stringent as it is in laser thermal printing, the loss of energy between modulator sites may be acceptable. Laser thermal printing requires much higher power densities than electrophotography and the brightness of the diode lasers used for such systems must be retained as it passes through the modulator to the media. Therefore the printing system should provide means to compensate for the low fill of the modulator array, otherwise the system will be inefficient.

U.S. Pat. application Ser. No. 08/427,523, assigned to the same assignee as the present invention, discloses a method for using a beamsplitter, to correct for the 50% fill of the modulator. This type of device shapes the light illuminating the modulator to miss the gaps and the modulator is then imaged to the media. A device of this type is cumbersome, since it attempts to put light on both rows of a modulator array, to achieve a 100% fill at the media plane.

SUMMARY OF THE INVENTION

It is an object of the present invention to provide a laser thermal printer and method for imaging pixels onto a media plane to achieve a 100% fill at the media plane, with a modulator having less than a 100% fill within one row.

The present invention provides a light modulation and exposure system comprising a laser light source; means for illuminating a modulator array with the laser light source; means for imaging light from the modulator array onto a light-sensitive media; and means for transferring into a row of modulator sites on the modulator array the data to be imaged onto the light-sensitive material.

In particular the invention comprises illumination optics which combines light from each diode laser in a laser array, and focuses it onto a modulator lenslet array with substantially 100% fill. The modulator lenslet array focuses light onto modulator sites on a modulator array with less than 100% fill. A printing lens, located downstream of the modulator array, focuses an image of the modulator lenslet array onto a media plane. This arrangement achieves a 100% fill at the media plane in cases when the modulator sites have gaps between the modulator sites, without being excessively complex or expensive. The invention, and its objects and advantages, will become more apparent in the detailed description of the embodiments presented below.

DETAILED DESCRIPTION OF THE INVENTION

Figure 1:
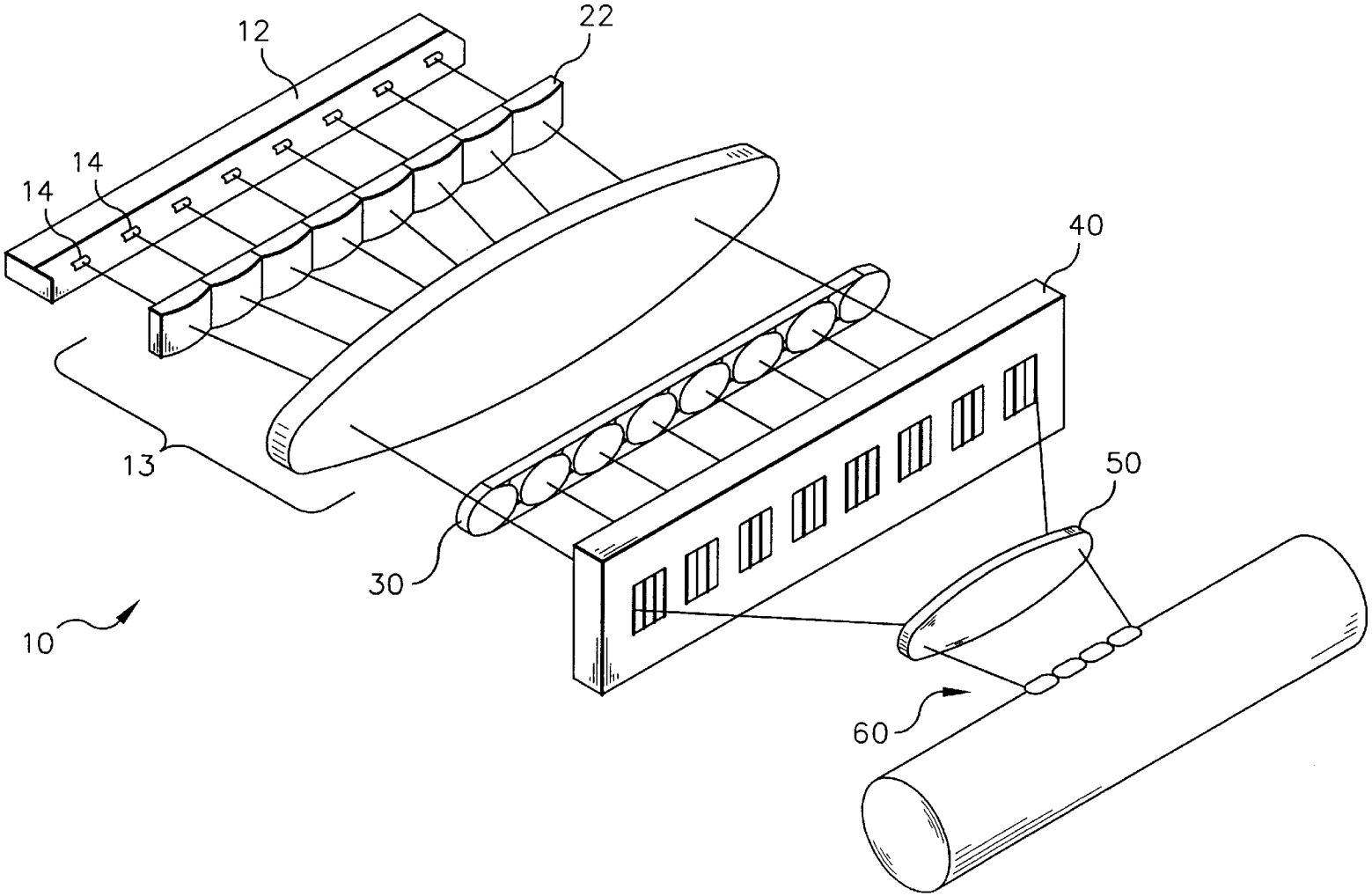
FIG. 1 is a perspective view of a laser printing apparatus according to the present invention.

Referring now to FIG. 1, a laser thermal printer is shown, referred to in general by numeral 10. The laser thermal printer is comprised of, in general, a laser array 12, illumination optics 13, a modulator lenslet array 30, a modulator array 40, a print lens 50, and a light sensitive material, located at the media plane 60.

Laser array 12, is comprised of large area, multimode diode lasers 14. The light from each diode laser 14 is not coherent with light from any other diode laser, so the light from the various diode lasers can be superimposed without inducing interference patterns that would degrade the illumination uniformity, and it has minimal filamentation effects. Thus the profile of the light from the diode lasers is fairly uniform, as internal interference effects are minimized.

Multimode diode lasers 14 are driven by a single power supply. Because the diode lasers operate at high power, they cannot be placed in a closely packed formation due to potential thermal cross talk. Thus, the active areas of the diode lasers are separated, and each one occupies a fraction of the array length.

Each of the diode lasers 14 is magnified. and imaged in overlapping fashion to flood illuminate the modulator array 40, in order to provide redundancy against failure of any single diode laser. Large area multimode laser diodes are naturally suited for flood illumination. The light profile from the multimode diode lasers is more uniform than the Gaussian profile of the single mode diode lasers, and therefore illuminates the modulator array 40 more uniformly. Because a thermal media is a threshold type media, Gaussian spots, with the long tails associated with single mode lasers, are not optimal for printing. The optics used in the present invention discussed in more detail below, images evenly illuminated pixels to the media, with the resulting pixel profiles being more steeply sloped than a Gaussian profile, and thus more optimal for thermal printing.

Figure 2:
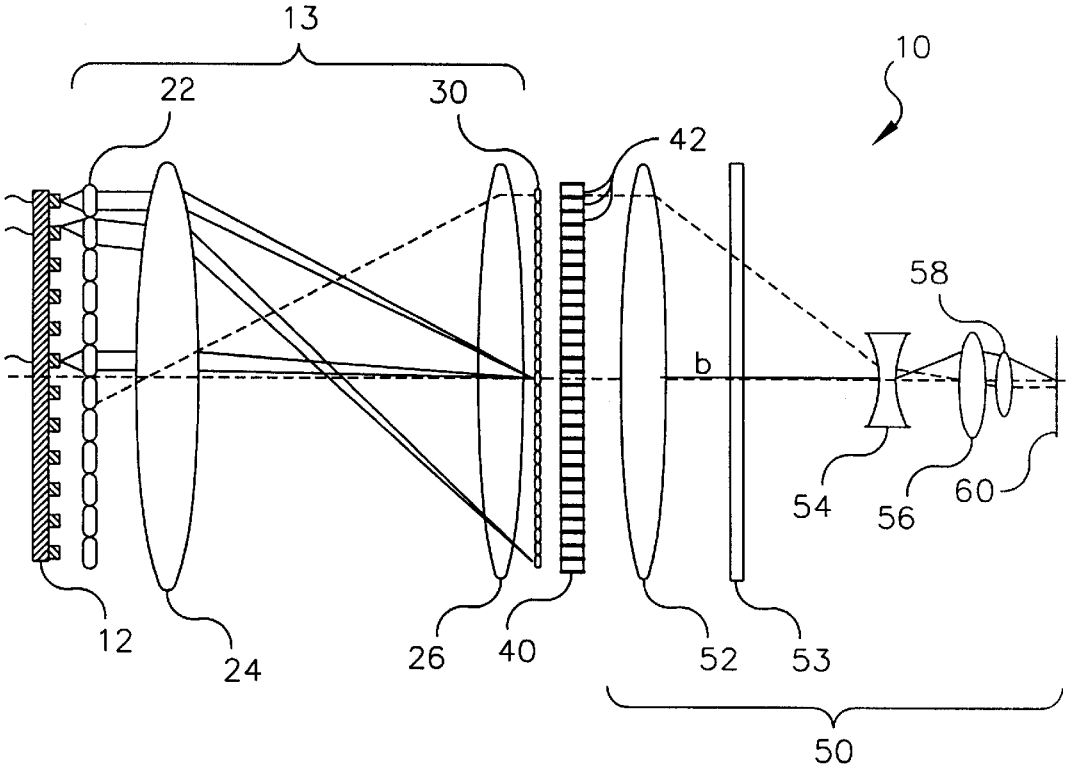
FIG. 2 is a top plan view of the invention shown in FIG. 1, showing additional details of the optics arrangement.

The emitting area width of each diode laser 14 is typically about 1 $\mu$m, and the emitting area length is about 100 to 200 $\mu$m. The numerical aperture of the emitted beams are approximately 0.10–0.14 in the array direction, and 0.5–0.6 in the cross array direction. Laser array 12 is made of 10 to 20 diode lasers 14. For purposes of illustration, FIG. 2 shows twelve diode laser elements. Each diode laser element emits about 1 watt of power in the near infrared with a wavelength between 750 nm to 900 nm. A typical laser array is, for example, the Optopower OPC-A010 laser (Opto Power Corporation, City of Industry, Calif.), a 10 Watt laser array consisting of 12 diode lasers, each some 200 $\mu$m wide, and spaced apart on a 800 $\mu$m pitch, to attain an overall laser array length of 9.0 mm. This laser array emits linearly polarized light at 810 nm, with a numerical aperature of 0.12 in an array direction and a cross array numerical aperature of 0.6.

It is difficult to collect the light from a source which is 9–10 mm wide and has an numerical aperature of 0.6. (For comparison, a microscope objective with numerical aperature of 0.5 typically has a field of only a fraction of a millimeter.) Complex illumination optics are therefore used to collect, collimate, shape and combine the light from the diode lasers 14. Because of the very different light emission characteristics of the diode lasers in the array direction, and cross array direction, the optical system shown in FIGS. 1 and 2 is anamorphic, particularly before the modulator array 40. FIG. 2 shows details of the optical system in an array direction, a direction parallel to the longitudinal axis of laser array 12, from the laser to the media plane.

Illuination optics 13 may take many forms, however, in the preferred embodiment, it is comprised of a laser lenslet array 22, used to collimate the light from diode lasers 14; a condenser lens 24, used to image the diode lasers 14, so that the images of the diode lasers are magnified to the size of the modulator array 40 and overlapped on top of each other; and a field lens 26 to make the light from the field lens telecentric to the modulator array 40. Laser lenslet array 22 collimates the light from the individual diode lasers in the array direction, and preferably consists of cylindrical lens elements, which can be either refractive or diffractive.

Laser lenslet array 22 effectively reduces the array lagrange (half width times the Numerical Aperture) to 0.144 mm, from 0.54 mm, by effectively removing the 600 $\mu$m gaps between the laser diode lasers 14. (By comparison, most laser sources have lagrange values that are considerably smaller, on the order of 0.002–0.004 mm.) Since each of the laser diodes is a multimode source, the output beam doesn't have a typical Gaussian profile character. The array direction beam profiles are typically rather flat topped, with some ripples and edge roll off. The sources are essentially incoherent, and light from one diode laser does not interfere with light from other diode lasers. The combination of the large lagrange and the incoherent non-Gaussian emissions means that these lasers can be considered to be miniature extended sources. Thus, when these lasers are imaged together, or flooded, onto the modulator lenslet array 30 and the modulator array 40, consideration must be given to both the physical and geometrical optics influences.

A 100% fill modulator lenslet array 30, condenses and focuses the light from the illumination optics 13 to fit within the modulator sites 42 on modulator array 40. Modulator lenslet array 30 preferably consists of cylindrical elements 32, either refractive or diffractive, whose focal length is predetermined so as to just underfill the modulator sites 42. Each lenslet 32 touches the adjacent lenslet, thus giving the modulator lenslet array 30 a 100% fill.

The modulator array 40 has a 50% fill. This means that modulator sites 42 occupy only half of the length of the modulator array. In the preferred embodiment, modulator array 40 is an electro-optic device comprised of a material which changes optical polarization characteristics in accordance with the strength of an electric field. A material typically used in such a device is lanthanum doped lead zirconate titanate (PLZT).

In the array direction, a direction approximately parallel to the longitudinal axis of the laser array 13, the print lens 50 images the modulator lenslet array 30, rather than the modulator array 40, onto the media plane 60, maintaining the 100% fill factor of the modulator lenslet array. In the optical design, the modulator sites 42 are regarded as windows.

Print lens 50 is comprised of a number of optical elements. Typical elements include a field lens 52; a polarization analyzer 53 which passes light of the proper polarity from modulator array 40 to the media plane 60; a concave lens 54; and lenses 56 and 58. Print lens 50 moves as a unit. Print lens 50, in the preferred embodiment, does not have an anamorphic design. While an anamorphic design, would correct for the astigmatism between the array and cross array directions and make the system be less sensitive to the cross array depth of focus, the print lens would be more complicated, and more expensive.

The diode lasers 14 are imaged to the modulator array 40 by the illumination optics 13 in overlapping fashion. That is all diode lasers send light to all locations on the modulator. This redundancy desensitizes the system to the operation of any particular diode laser. For example, the center of the diode lasers 14*a* and 14*f*, shown in FIG. 2, are coincident at the center of the modulator array 40. Similarly, the edges of each of the diode lasers are imaged to the edge of the modulator array 40, as shown by the rays from diode laser 14*b*. Then each lenslet of modulator lenslet array 30 is imaged by the print lens 50 to the media plane 60, as shown by ray "b".

Figure 3:
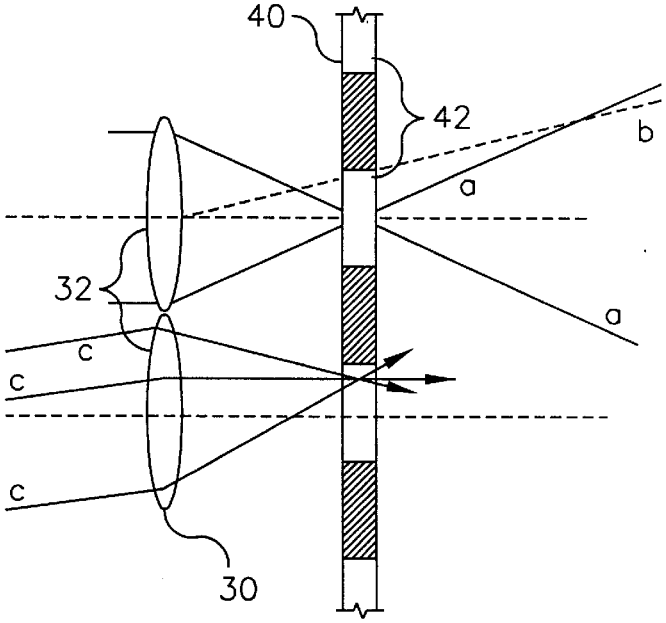
FIG. 3 is a top schematic view of the invention shown in FIG. 2, showing details of the modulator lenslet array and the modulator array.

In FIG. 3, the rays "a" show the focusing action of the modulator lenslets 32 onto the modulator sites 42. The modulator lenslet array 30 is nominally located one focal length (of the modulator lenslet array) from the field lens 26. Modulator lenslet array 30 is also located one focal length (of the modulator lenslet array) from the modulator array 40. Since each lenslet 32 of modulator lenslet array 30 images the entire laser lenslet array 22 onto a given modulator site 42, the incident light will be telecentric to the modulator sites 42. This is shown by rays "c". Ray "b" shows an axial ray (from the point of view of the print lens) as it passes through the modulator array 40.

Each of the lenslets 32 in the modulator lenslet array 30 images the full width of the laser lenslet array 22 into each modulator site 42, but with a fractional portion of the numerical aperature incident onto the entire modulator plane. Given that the laser lenslet array 22 size, the modulator site 42 size, and the condenser lens 24 focal length are known, the magnification to the modulator sites 42, and the modulator lenslet 30 focal length can be determined. However, the fractional numerical aperature from subsampling by N, the number of lenslets, is quite small, for example, 0.03. Because of the non-coherent nature of the illumination, the physical optics Airy disc model for the size of a focused spot is relevant. The Airy disc spot diameter for a numerical aperature 0.03 beam is 33 $\mu$m, which is large relative to both the 63.5 $\mu$m width of the modulator sites 42, and the geometrical image of laser lenslet array 22. The actual spot size can be estimated by convolving the geometrical width with the Airy disc spot. Using this spot size estimate, an acceptable modulator lenslet array focal length, and incident numerical aperature into the modulator sites, can be determined based on the modulator site size and a tolerance for light lost. For this system, a modulator lenslet array focal length of 2.35 mm was chosen. The geometrical spot diameter was 35 $\mu$m, the Airy disc diameter was 31 $\mu$m, and the convolved spot size was 55 $\mu$m, which fits inside the sites 42 with some clearance, and with very little light lost in the tails of the spot. A range of acceptable focal lengths for the lenslets 32 of the modulator lenslet array 30 was determined to be 2.1 mm to 2.7 mm, which is quite different from the 7.2 mm focal length which would be designed by geometrical considerations alone. This analysis ignores aberrations effects.

Figure 4:
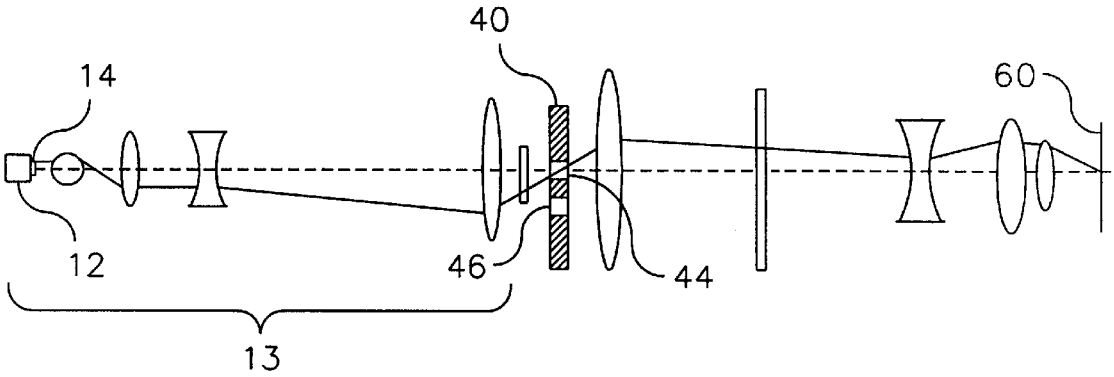
FIG. 4 is a side plan view of the invention shown in FIG. 1, showing additional details of the optics arrangement.

FIG. 4 shows the cross array optical system, which is quite different from the array direction in the area before the modulator array 40. In the cross array direction, the illumination optics 13 focus the light to the modulator array 40, rather than to the lenslet array 30. By comparison to the array direction, in the cross array direction the print lens 50 images the modulator array 40 to the media plane 60, rather than imaging the modulator lenslet array 30 to the media plane 60. Rows 44 and 46, of modulator sites 42, are offset vertically. (For clarity, many of the array optical elements shown in FIG. 2 are not shown in FIG. 4.) In the cross array direction, the diode lasers 14 emit light coherently, with a Gaussian beam profile. The print lens 50 is preferably telecentric to both the modulator array 40 and media plane 60, in both the array and cross array directions.

Figure 5:
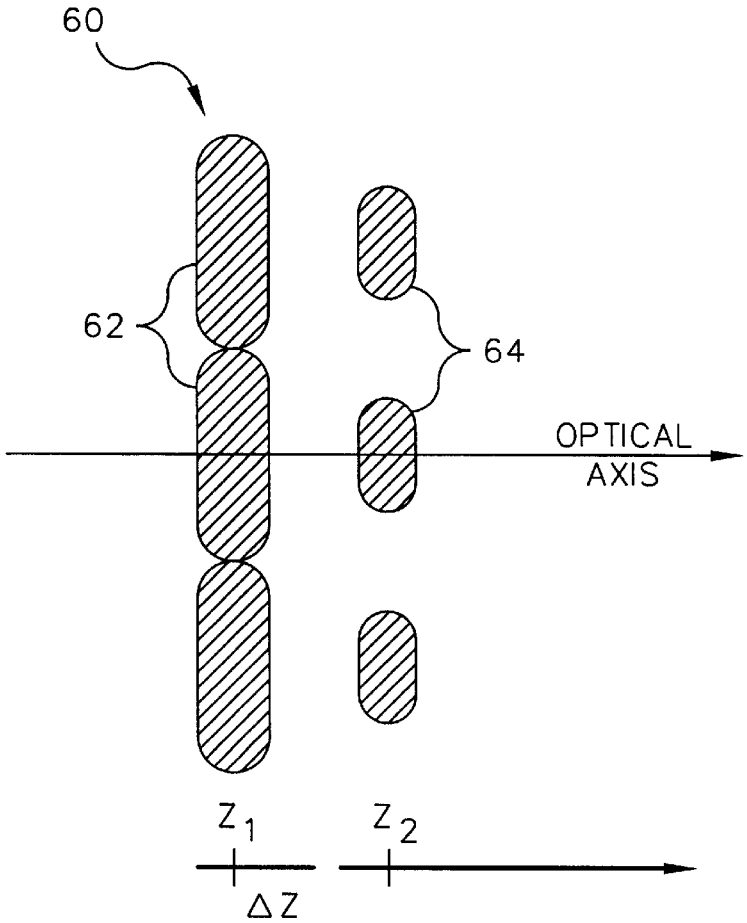
FIG. 5 illustrates pixel characteristics and relative positions at and near the media plane.

FIG. 5 shows the pixel or spot size at the media plane. The view is form the top, as in FIG. 2, with pixels 62 and 64 rotated 90° along the array axis for purposes of illustration. In the array direction, the lenslets 32 of lenslet array 30 are imaged to one location ($Z_1$ ), and the modulator sites 42 to another location ($Z_2$), a small distance in back of the media plane 60. But in the cross array direction, while the modulator array 40 is imaged to $Z_2$, there is no effective imaging of the lenslet array 30. In effect there is intrinsic astigmatism between the array and cross array foci. The cross array beam size at the desired $Z_1$ image, the location of media plane 60, can then determined by accounting for the cross array beam defocus. The cross array depth of focus must be large enough to significantly maintain the cross array pixel size, so that over the $\Delta z$ distance, the power density isn't significantly reduced. Note that the focused pixels at the $Z_1$, plane have a lower power density than the pixels at the $Z_2$ plane, because the array pixel size changes by 2x, as shown in FIG. 5.

Alternately, the system could be used with the $Z_2$ plane of FIG. 5 as the designated media plane. In that case, as the astigmatism between the array and cross array light is removed, and the system is less sensitive to the cross array depth of focus. As the $Z_2$ plane is inherently the plane of highest power density, the system would print more efficiently when used in this manner. However, as the printed pixels are not immediately adjacent, but are spaced apart by a pixel width (50% fill), a data interleaving scheme would need to be applied to control the printing and fill in the gaps. This would require a more complex electronics datapath.

Figure 6:
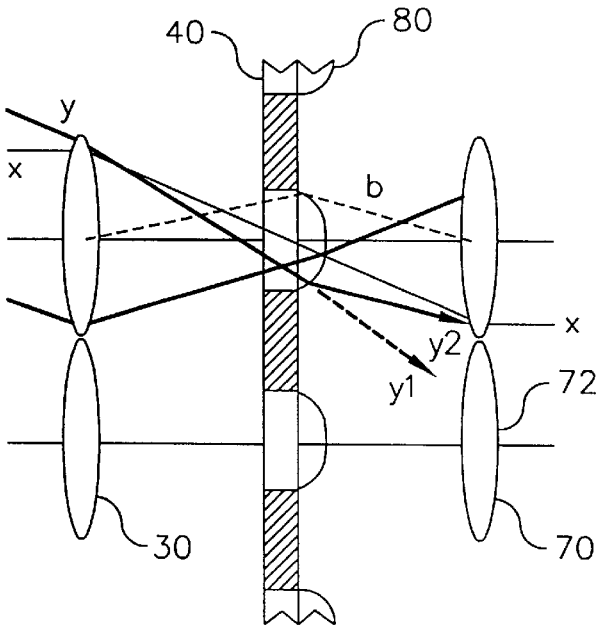
FIG. 6 is a top schematic view of an alternate embodiment of the invention, showing details of the modulator lenslet array and the modulator array.

In an alternate embodiment, shown in FIG. 6, additional lenslets are used in proximity to, and particularly after, the modulator array 40. A third lenslet array 70, located approximately one focal length from modulator array 40, collimates the light from the modulator sites 42, as shown by ray x. However, as the laser array 13 has an appreciable field and lagrange, light from off axis diode lasers, such as shown by ray y, can pass through a modulator site and hit the wrong output side of lenslet 72, as shown by ray $y^1$. This will cause a cross talk error, as well as potential light loss due to vignetting in the print lens. This is corrected by placing a fourth lenslet array 80 at the modulator plane, which images modulator lenslet array 30 onto third lenslet array 70. Ray y will then be redirected onto path $y^2$. In this embodiment, the print lens images the lenslet array 70 to the media plane with a 100% fill. This avoids the unusual construction of imaging an object, modulator lenslet array 30, through a window, modulator sites 42. However, this alternate embodiment complicates the system, as the additional third lenslet array 70 and fourth lenslet 80 must be aligned. These additional components also reduce efficiency and increase cost.

Figure 7:
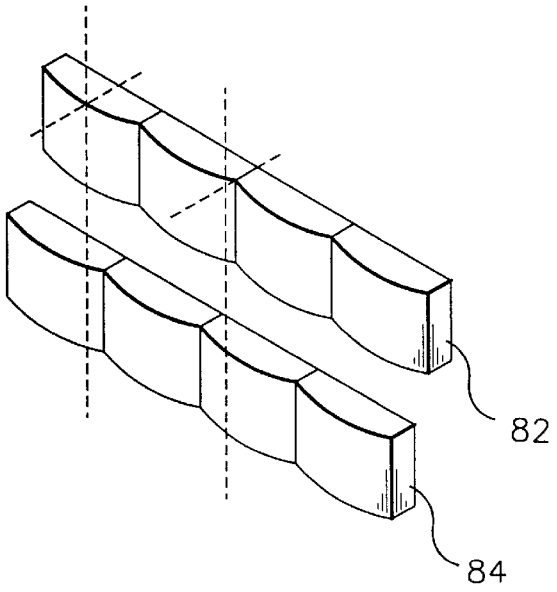
FIG. 7 is a perspective view of an alternate embodiment of the invention, with two modulator lenslet arrays having two rows of offset cylindrical lenslets.

In another embodiment, two rows of offset 100% fill modulator lenslets arrays 82 and 84, are arranged one above the other, as shown in FIG. 7. Modulator lenslet arrays 82 and 84 are matched to a modulator array with two rows of vertically offset, 50% fill modulator sites. (The dashed lines in FIG. 7 indicate that the two rows of lenslets are laterally offset by one half of a lenslet width.) In this way a 100% fill at the media plane can be achieved with a modulator with only 50% fill in each row. In yet another embodiment, lenslets 82 and 84 can have power in both directions, particularly if the lenslets are rectangular, rather than square. Also, both the preferred embodiment, as well as the alternate embodiments, may have modulator sites with other shapes, such as square or rectangular.

Figure 8:
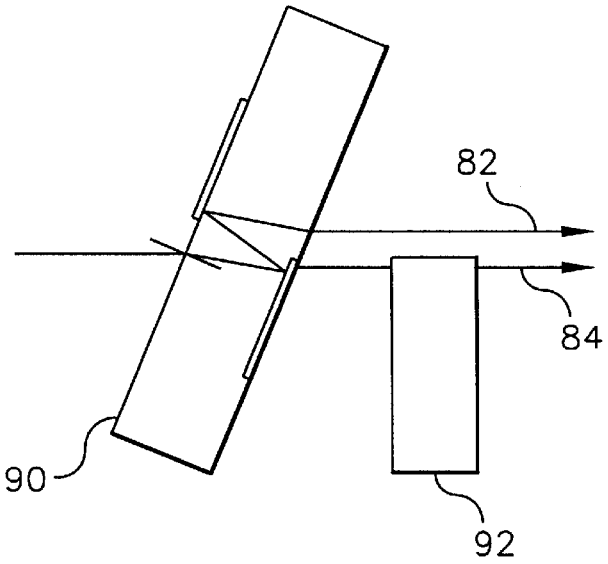
FIG. 8 is a schematic view of another embodiment of the invention, with a beamsplitter.

Since the two rows of modular site 46 and 44, shown in FIG. 4, are vertically offset, a beamsplitter 90, shown in FIG. 8, is provided to divide the incoming light into two beams directed onto cylindrical lenslets comprising lenslet arrays 82 and 84. Beamsplitter 90 is located before field lens 26. Thus minimal light is put into the gap between the two rows of modulator sites. See FIG. 4. In this configuration, with the offset 100% fill, the printing lens can image the modulator array, rather than the lenslet array to the media. Therefore, this system maintains high efficiency, as well as providing high power density spots, without comprising depth of focus. As there is an effective 100% fill at the media plane for each row, data interleaving of the rows is not necessary, though there is a time delay in writing the two rows of data. This system does have added complexity, as additional components such as the beamsplitter and compensator plate 92 are needed.

Figure 9:
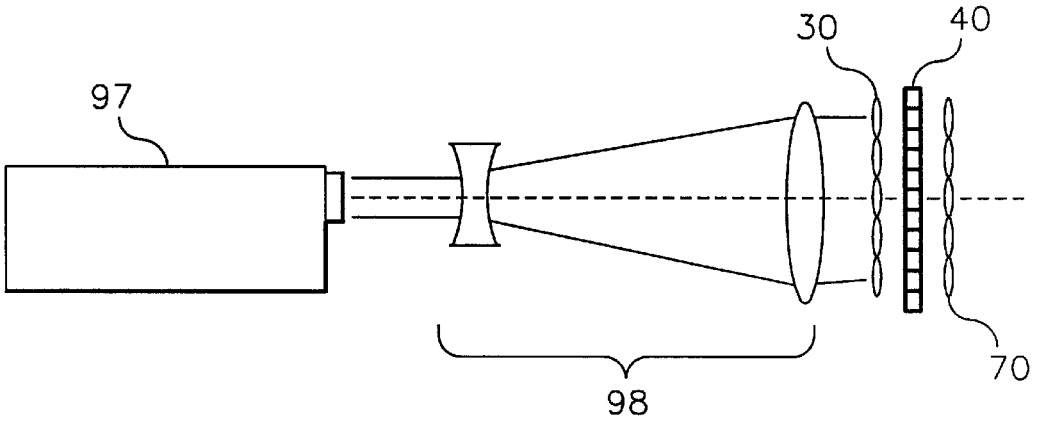
FIG. 9 is a schematic view of yet another embodiment of the invention, using a large cavity laser.

Yet another alternate embodiment uses an entirely different laser source such as a single large cavity laser, for example, a ND-YAG or excimer laser 97, as shown in FIG. 9. In the simplest form, the laser 97 is followed by a beam expander 98 to bring the beam to the size of the modulator array 40. Prior to the modulator, homogenizing optics (not shown) are used to make the beam uniform. The beam is then focused by the 100% fill lenslet array 30, to condense the beam through the modulator sites 42. After the modulator array 40, either a printing lens 50 can be used directly, as shown in FIG. 2, or indirectly, with a third lenslet array 70, as shown in FIG. 9, preceding the print lens. In the first case, the print lens 50 images the lenslet 30 to the media plane. In the second case, the 100% fill lenslet array 70 is imaged directly to the media plane. A fourth lenslet array would not be required. This is because a large cavity laser typically has a much smaller lagrange, than a diode laser array. With a large cavity laser, there is almost no field, and the beam can essentially pass through the modulator sites and printing lens with little misdirection, cross talk, or vignetting. However, in such a system, there is only one laser source, so there is no source redundancy. Also such lasers can be fairly expensive compared to a diode laser array.

The invention has been described in detail with particular reference to preferred embodiments thereof, but it will be understood that variations and modifications can be effected within the spirit and scope of the invention. Descriptions were directed in particular to elements forming part of, or cooperating more directly with, apparatus in accordance with the present invention. It is to be understood that elements not specifically shown or described may take various forms well known to those skilled in the art. While the invention is described in the environment of a laser thermal printer, it will be noted that the invention can be used with other types of apparatus that must be imaged on a plane. It is understood that using lenslet arrays before a low fill modulator are not limited to modulator arrays with 50% fill, but are applicable to any modulator array having less than 100% fill.

PARTS LIST

10. Laser thermal printer
12. Laser array
13. Illumination optics
14. Diode lasers
22. Laser lenslet array
24. Condenser lens
26. Field lens
30. Modulator lenslet array
32. Cylindrical elements
40. Modulator
42. Modulator sites
50. Print lens
60. Receiver/media plate
70. Third lenslet array
72. Lenslet
80. Fourth lenslet array
82. Lenslet array
84. Lenslet array
90. Beamsplitter
92. Compensator plate
97. Excimer laser
98. Beam expander

What is claimed is:

1. A laser printer for printing at a printing site, said printer comprising:

a laser array comprised of a plurality of diode lasers arranged in a first linear direction, each diode laser emitting a separate light beam;

illumination optics for collecting the light beams from the plurality of diode lasers to provide flood illumination in a second linear direction parallel the first linear direction;

a modulator lenslet array comprised of a plurality of lenslets, said modulator lenslet array having 100% fill in the second linear direction;

a modulator array comprised of a plurality of modulator sites, said modulator array having less than 100% fill in a third linear direction parallel the first linear direction, wherein each lenslet in the modulator lenslet array focuses light from said illumination optics onto each of the modulator sites; and a print lens adapted to image the modulator lenslet array onto the printing site as an array of pixels having 100% fill in a fourth linear direction parallel the first linear direction.

2. A laser printer as in claim 1 wherein each of said lenslets has a focal length, said focal length being the same for each of said lenslets, and said modulator lenslet array is located a distance equal to one times said focal length in front of said modulator array.

3. A laser printer as in claim 1 wherein said diode lasers are multimode diode lasers.

4. A laser printer as in claim 1 wherein each of said lenslets are cylindrical elements.

5. A laser printer as in claim 1 wherein light from said modulator lenslet array is focused only on said modulator sites.

6. A laser printer as in claim 1 wherein said illumination optics combines light from each diode laser so that light from each diode laser is provided to each lenslet of said modulator lenslet array.

7. An imaging apparatus for a laser printer comprising:

a laser array, comprised of a plurality of diode lasers each of which emits a beam of light;

a first lenslet array, comprised of a plurality of first lenslets, located adjacent to said laser array wherein each of said first lenslets collimates the light from the diode laser located adjacent to each first lenslet;

a condenser lens which magnifies and overlaps the light from said first lenslets;

a field lens which adapts light from said condenser lens to be telecentric to a second lenslet array comprised of second lenslets, each of said second lenslets contacting an adjacent second lenslet;

a modulator array having modulator sites which are separated from adjacent modulator sites a predetermined distance, wherein each of said second lenslets focus light from said field lens onto the modulator sites; and a print lens adapted to image said second lenslet array onto a media plane providing 100% fill at the media plane.

8. An imaging apparatus as in claim 7 wherein;

a third lenslet array comprising a plurality of third lenslets is located approximately one focal length from said modulator array, and between said modulator array and said print lens, wherein each of said third lenslets collects light from said modulator sites; and a fourth lenslet array comprising a plurality of fourth lenslets, located immediately adjacent said modulator array, wherein each of said fourth lenslet images each of said second lenslets onto a corresponding third lenslet.

9. An imaging apparatus for a laser printer comprising:

a laser array, comprised of a plurality of diode lasers each of which emits a beam of light;

a first lenslet array, comprised of a plurality of first lenslets, said first lenslet array located adjacent said laser array wherein each of said first lenslets collimates the light from the diode laser adjacent to each first lenslet;

a condenser lens which magnifies and overlaps the light from said first lenslets;

a field lens which adapts light from said condenser lens to be telecentric to a modulator lenslet array comprised of second lenslets each of said second lenslets contacting an adjacent second lenslet;

a modulator array having modulator sites which are separated from adjacent modulator sites a predetermined distance, wherein each of said second lenslets focus light from said field lens onto a modulator site; and wherein said print lens is adapted to image said modulator array onto a media plane.

10. A laser printer for printing at a printing site, said printer comprising:

a large cavity laser which emits a light beam;

illumination optics for expanding and collimating of the light beam;

a modulator lenslet array, comprised of a plurality of first lenslets having 100% fill in an array direction;

a modulator array comprised of a plurality of modulator sites having less than 100% fill in an array direction, wherein each first lenslet in the modulator lenslet array focuses light from said illumination optics onto the modulator sites; and a print lens adapted to image an array of pixels to a media plane wherein said pixels have a 100% fill in an array direction.

11. A laser printer as in claim 10 wherein said print lens images said modulator lenslet array onto the printing site.

12. A laser printer as in claim 10 wherein;

a post modulator lenslet array comprised of a plurality of second lenslets, located one focal length from said modulator array and before said print lens; and wherein said print lens images said post modulator array, onto said printing site.

13. A method of imaging multi-beam light sources onto a printing site media, said method comprising the steps of:

generating a plurality of light beams;

reducing the divergence of the light beams;

combining the light beams;

flooding each lenslet on a 100% fill lenslet array with the combined light beams;

focusing light from each lenslet onto sites on a modulator array having less than 100% fill; and imaging said lenslet array onto said printing site to form a plurality of pixels with a 100% fill.

* * * * *